US006276681B1

(12) United States Patent
Doucet

(10) Patent No.: US 6,276,681 B1
(45) Date of Patent: Aug. 21, 2001

(54) PRODUCT DELIVERY APPARATUS HAVING REPLACEABLE ELEMENTS

(75) Inventor: Louis John Doucet, Salem, NH (US)

(73) Assignees: Heidelberg Harris Inc., Dover, NH (US); Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 08/429,155

(22) Filed: Apr. 26, 1995

(51) Int. Cl.[7] ..... B65H 29/00

(52) U.S. Cl. ..... 271/315; 271/187; 198/473.1

(58) Field of Search ..... 271/315, 187; 198/473.1, 803.2, 803.01; 270/45, 47, 49, 50; 29/889.7, 592

(56) References Cited

U.S. PATENT DOCUMENTS

| | | | | |
|---|---|---|---|---|
| 2,014,933 | * | 9/1935 | Harless et al. | 271/315 |
| 3,162,439 | * | 12/1964 | Poland et al. | 271/187 |
| 4,052,053 | * | 10/1977 | Hasegawa et al. | 271/315 X |
| 4,075,086 | * | 2/1978 | Marsh, III et al. | 198/473.1 X |
| 4,357,008 | | 11/1982 | Campbell | 271/315 |
| 4,537,390 | * | 8/1985 | Kiameo et al. | 271/315 X |
| 4,681,209 | * | 7/1987 | Marti | 198/473.1 X |
| 4,715,594 | * | 12/1987 | Isobe et al. | 271/187 X |
| 4,848,533 | * | 7/1989 | Martin et al. | 198/473.1 X |
| 4,925,179 | | 5/1990 | Breton et al. | 271/187 |
| 5,083,768 | | 1/1992 | Ertavi et al. | 271/182 |
| 5,098,080 | | 3/1992 | Arnone et al. | 271/187 |
| 5,112,033 | | 5/1992 | Breton | 270/47 |
| 5,156,389 | * | 10/1992 | Novick | 198/473.1 X |
| 5,180,160 | | 1/1993 | Belanger et al. | 271/315 |

FOREIGN PATENT DOCUMENTS

| | | | | |
|---|---|---|---|---|
| AS 1 093 296 | | 11/1960 | (DE) . | |
| AS 1 213 859 | | 5/1964 | (DE) . | |
| 2 024 169 A | | 1/1980 | (GB) . | |
| 2221452 | * | 2/1990 | (GB) | 271/187 |
| 36265 | * | 2/1987 | (JP) | 271/315 |
| 6-040 636 | | 2/1994 | (JP) . | |

* cited by examiner

*Primary Examiner*—Frank E. Werner
(74) *Attorney, Agent, or Firm*—Burns, Doane, Swecker & Mathis, LLP

(57) ABSTRACT

The present invention relates to a device for replacing elements of a product delivery fan wheel which is rotatably mounted. The fan wheel has a plurality of fan blades which include attaching devices for replaceably mounting fan blade tips on the fan blades.

26 Claims, 4 Drawing Sheets

PRODUCT DELIVERY APPARATUS HAVING REPLACEABLE ELEMENTS

FIELD OF THE INVENTION

The present invention relates to a product delivery apparatus, such as a fan wheel or the like of a printing press, having replaceable elements.

BACKGROUND OF INVENTION

U.S. Pat. No. 4,357,008 discloses a creel assembly for use in a business forms delivery apparatus wherein individual business forms are received between adjacent spirally formed fingers of a plurality of aligned creel assemblies. Business forms are inverted from a "face-up" to "face-down" position.

U.S. Pat. No. 4,925,179 discloses a delivery fan with undulated fan pockets. The fan includes two sets of blades. The blades of one set are equally spaced apart axially and define one side of each pocket. The blades of the other set are equally spaced axially define the other side of each pocket. The blades of the two sets have surfaces for engaging opposite sides of a signature and for deforming the signature into undulations extending in a direction transverse to the direction of movement of the signature. Due to frictional contact between the signature and the surfaces of the pocket, the signature is slowed down to minimize buckling or bouncing of the signature in the respective pocket.

U.S. Pat. No. 5,083,768 discloses a device for reducing the velocity of impact of printed products in the base of a delivery paddle wheel of printing presses. A shaft having cam plates with cams mounted thereon is assigned to a delivery paddle wheel. The cams catch the printed products arriving in the delivery paddle wheel at their trailing end and decelerate them. The shaft supporting said cams can be set according to different lengths of the printed products.

U.S. Pat. No. 5,180,160 shows a delivery device in a folding apparatus of a rotary printing press. The delivery device includes a fan wheel or several fan wheels disposed next to one another. The fan wheels are formed of individual fan blades between which fan wheel pockets are provided. Leading edges of the fan blades have a first profile and trailing edges of the blades have a second profile.

U.S. Pat. No. 5,112,033 discloses a folder apparatus for a web-fed printing press. There are two fan arrangements, each having a plurality of fan blades disposed parallel to the common axis of each other. The fan blades of each fan arrangement have tips located at a circumference of the respective fan arrangement in a common plane, with circumferences of the fan arrangements intersecting one another. A device is provided on the fan arrangements for preventing a collision of the respective fan blade tips.

SUMMARY OF THE INVENTION

Given the state-of-the-art, it is an object of the present invention to provide for replacing fan tips.

Furthermore, it is an object of the present invention to allow for an adjustment of the fan blade tip properties with regard to signature delivery requirements.

According to the present invention, exemplary embodiments of a product delivery apparatus having replaceable elements include:

at least one fan wheel which is rotatably mounted, a plurality of fan blades included on said at least one fan wheel, and attaching devices included on each of said fan blades for mounting replaceable fan blade tips to said fan blades.

Thus, an easy exchange of parts of the fan wheels is feasible without dismounting the fan wheel arrangement in its entirety. The solution allows for retrofitting of fan tips with fan blade tips having a different curvature or being of different material. Damaged fan tips due to wear can easily be exchanged. Furthermore, by mounting fan blade tips of different material a rebalancing of fan wheel arrangements can easily be achieved.

According to the invention not only attaching devices are provided but also abutting surfaces for aligning (for example, centering) fan blade tips relative to the respective fan blade ends. The attaching devices include snap-on devices of apertures and clips, or fastening screws, or cams of a certain shape engaging corresponding recesses of fan blade ends or blade tips or vice versa.

The replaceable fan blade tips can be made of any material, including, but not limited to, plastic (for example, plastic formed using any known processing technique including, but not limited to, injection molded plastic or structural foamed plastic), steel, aluminum or composites. These materials, can also be coated or plated with other materials, if they fulfill determining factors in tip material selection such as strength, friction characteristics, manufacturing method and tip configuration.

There are not only attaching devices provided on said replaceably mounted fan blade tips but also aligning means, such as centering pins or abutting surfaces. The shape and the orientation of said abutting surfaces prevent the fan blade tips from being mounted in a wrong orientation with regard to the sense of rotation of said fan wheel.

BRIEF DESCRIPTION OF THE DRAWINGS

Exemplary embodiments and methods of operation of the invention, together with additional objects and advantages thereof, will be best understood from the following description of specific exemplary embodiments when read in connection with the accompanying drawings wherein.

DESCRIPTION OF PREFERRED EMBODIMENTS

Figure 1:
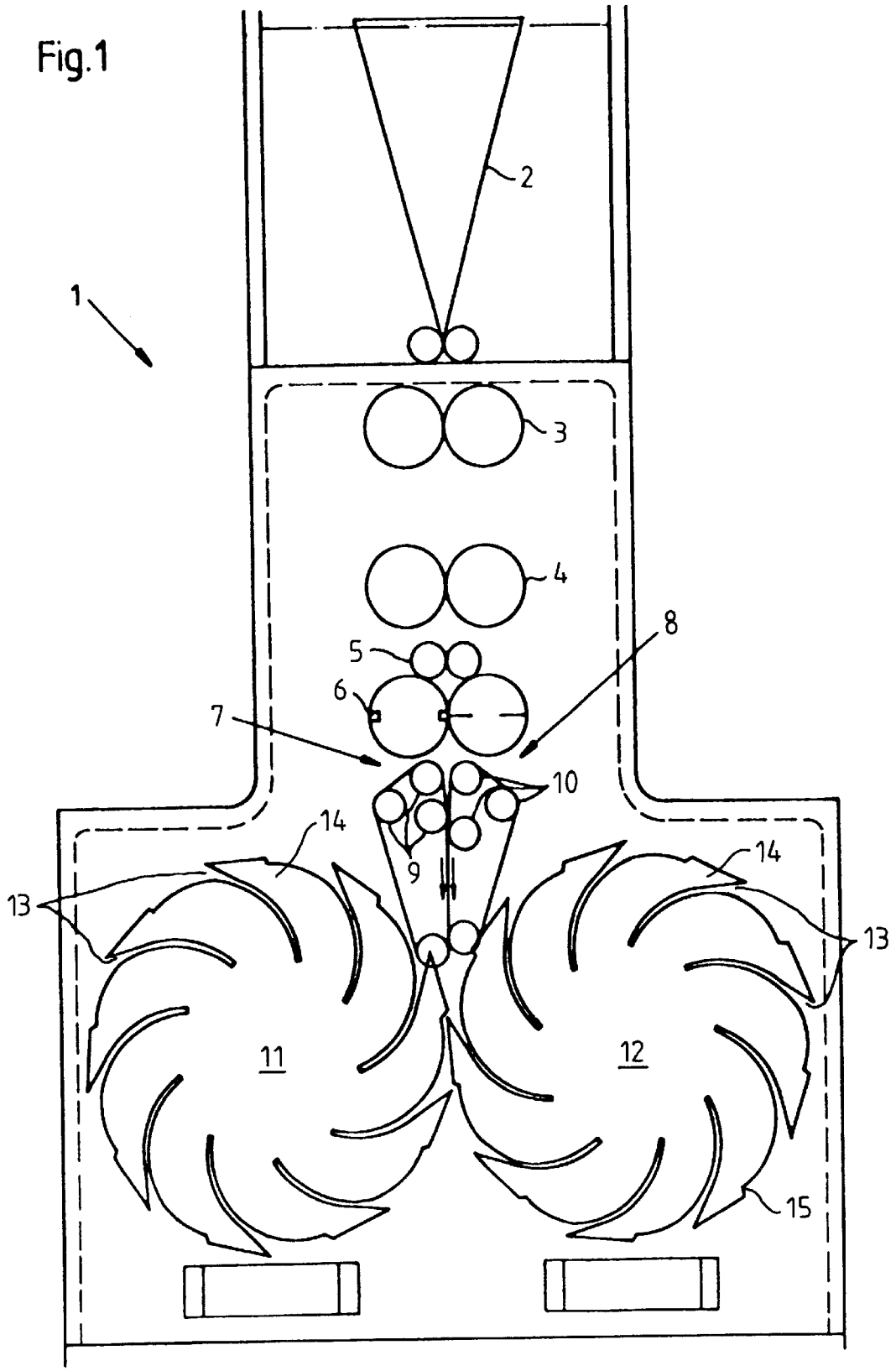
FIG. 1 shows a schematic view of a folder having two fans partially overlapping each other's envelope curve.

FIG. 1 shows a schematic view of an exemplary embodiment of product delivery device, represented as a folder having two partially overlapping fan wheels for transporting material.

A folder 1 includes a former 2 for leading a material, such as longitudinally folded continuous web of material, into upper draw rollers 3. After passing the upper draw rollers 3, the web enters lower draw rollers 4 and is subsequently conveyed via guide rollers 5 to a cutting cylinder 6 which severs samples from said continuous web of material. The samples are conveyed by a left lead-in tape 7 and a right lead-in tape 8 into fan-pockets 13 of two fans 11, 12, respectively. The circumferences of said fans 11, 12 constitute envelope curves which partially overlap each other. Thus, single samples are alternately led into every other one of the fan pockets 13 of said fans 11, 12. Each fan pocket 13 is formed between adjacent fan blades 14 of said fans 11, 12. Below said fans 11, 12, a conveying means, such as any known sample conveyor, are assigned to each of said fans for delivering said samples to further post press equipment.

As mentioned previously, the replaceable fan tips can be made of any material including, but not limited to, plastic, metal or composites. For example, replaceable fan tips can be made from plastic which is molded using any conventional technique, such as injection molded plastic or structural foamed plastic. Alternately, the replaceable fan blade tips can be machined from solid plastic. Where the replaceable fan blade tips are made from metal, they can be machined from solid stock, formed and welded from individual pieces, cast (or molded), or formed using any other conventional techniques. As mentioned previously, any composite material, including for example, carbon fiber, can be used to form the replaceable fan blade tips as well. Those skilled in the art will appreciate that the foregoing materials and techniques are by way of example only, and that any known material processed in any known way can be used to form the replaceable fan blade tips.

Figure 2:
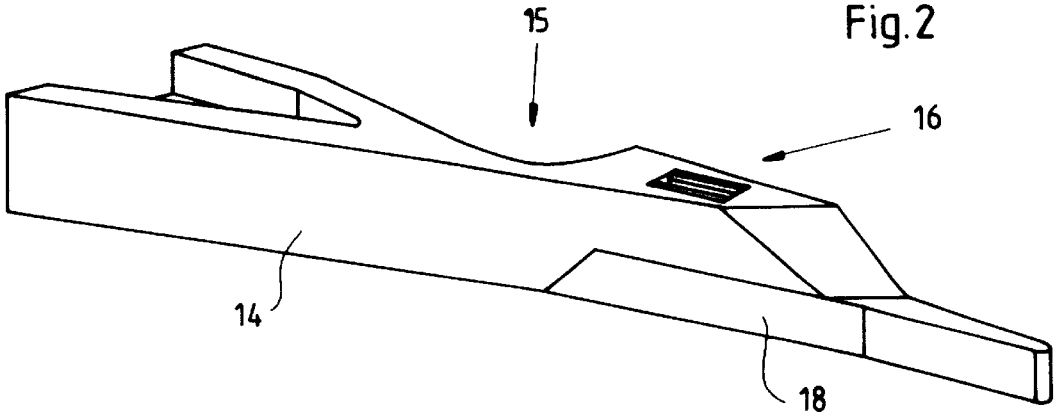
FIGS. 2, 2*a* and 2*b* show an exemplary embodiment of a snap-on replaceable fan blade tip.
Figure 2A:
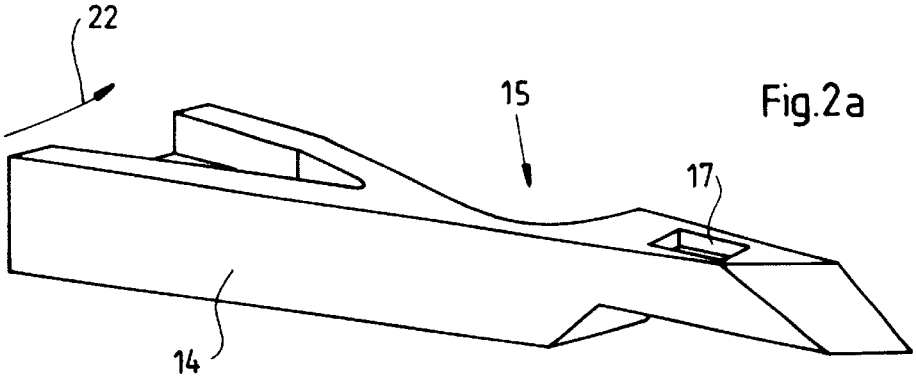
Figure 2B:
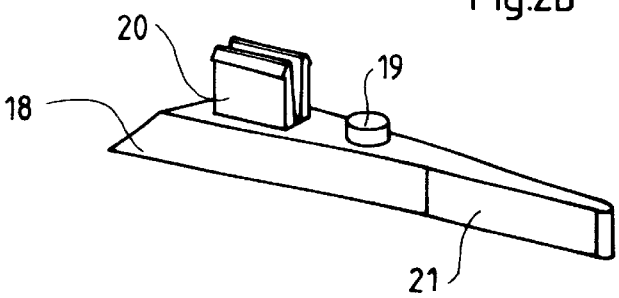

FIGS. 2, 2*a* and 2*b* show an exemplary embodiment of a snap-on replaceable fan blade tip in greater detail.

In FIG. 2 the assembly of fan blade 14 and replaceable fan blade tip 18 is shown. The fan blade 14 has a recess 15 into which—during rotation in the direction of arrow 22 in FIG. 2*a* —a corresponding fan blade tip of the other fan dives—due to the intersecting of the envelope curves of said fans 11, 12 as shown in FIG. 1.

An attaching device, represented as a mounting area 16, is defined by a plane where both fan blade 14 and replaceable fan blade tip 18 contact each other. A clip 20, as shown in FIG. 2*b*, can be included on the replaceable tip 18 for engaging an aperture 17 (FIG. 2*b*) in the mounting area of fan blade 14.

FIG. 2*a* shows an exemplary embodiment of fan blade 14 having an aperture 17 with rectangular shape. FIG. 2*b* shows an exemplary embodiment of a corresponding fan blade tip 14 having an engaging clip 20 and an aligning pin 19. The aligning pin engages a bore in the mounting area of fan blade 14 to align (for example, center) the fan blade tip with the fan blade. A product containing surface 21 of said fan blade tip 18 rotates into the direction of arrow 22 when mounted on fan blade 14 (FIG. 2*a*).

Figure 3:
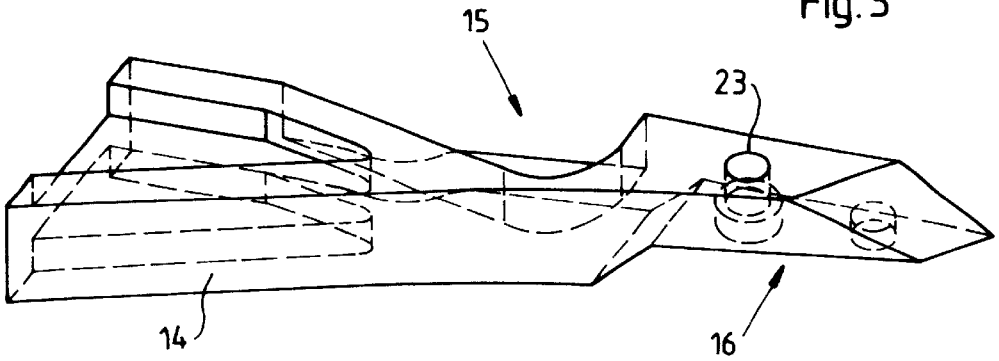
FIG. 3 shows an exemplary fan blade end section.
Figure 3A:
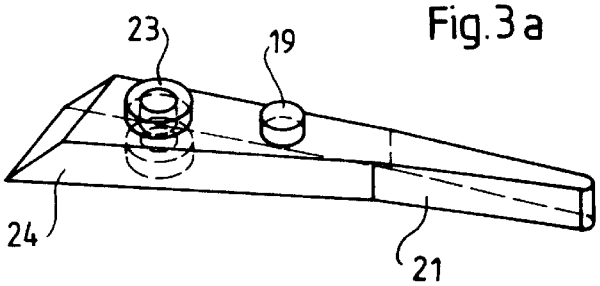
FIG. 3*a* shows an exemplary fan blade tip molded with foamed material, such as structural foamed plastic.
Figure 3B:
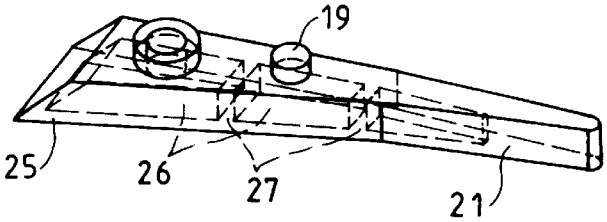
FIG. 3*b* shows a view of an exemplary fan blade tip molded with injection molded plastic.
Figure 3B:
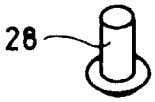

FIGS. 3, 3*a* and 3*b* show other exemplary embodiments of the present invention. In FIG. 3, a fan blade tip 14 has a receptacle, such as a threaded receptacle 23, above the mounting area 16. The receptacle can, for example, be an ultrasonic insert which is vibrated into place using ultrasound, in known fashion. The ultrasonic insert provides metal threads for mounting purposes.

The corresponding fan blade tips 24 and 25 shown in FIGS. 3*a* and 3*b*, respectively each have an aligning pin 19 for engaging said bore in the mounting area 16 of said fan blade 14. The fan blade tip 24 can, for example, be made of foamed material, whereas the fan blade tip 25 of FIG. 3*b* can be injection-molded, having recesses 26 being separated by traverses 27 to enhance stiffness of the fan blade tip 25. By means of any fastening device such as a screw 28 or the like, the fan blade tips 24 and 25 can be mounted on fan blade 14. The screw 28 or the like engages the threaded receptacle 23 provided in the plastic material as an alternative to the snap-on device shown in FIGS. 2–2*b*.

Figure 4:
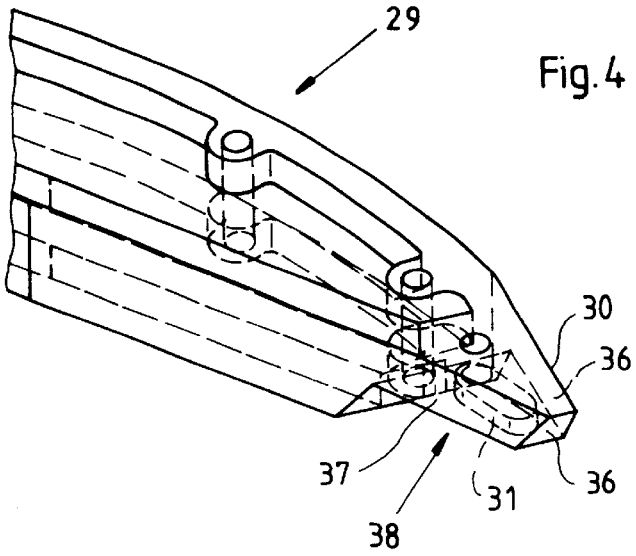
FIG. 4 shows an exemplary fan blade end section.
Figure 4A:
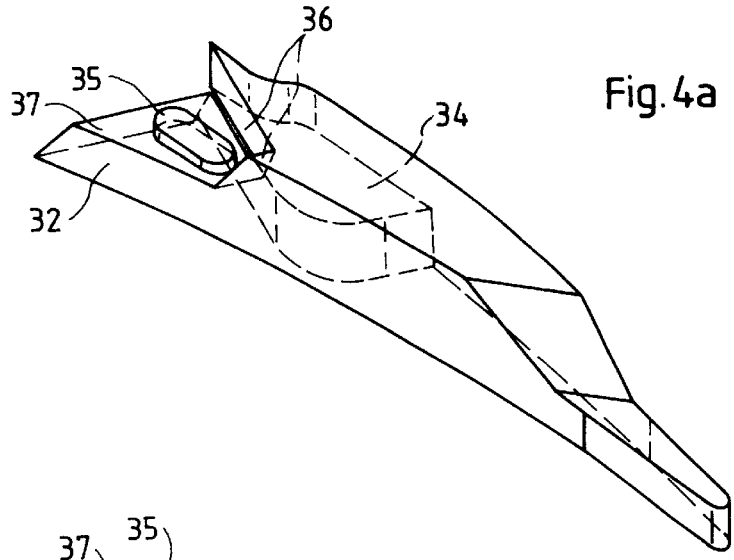
FIGS. 4*a* and 4*b* show exemplary embodiments of fan blade tips which can be mounted on fans rotating in opposite directions.
Figure 4B:
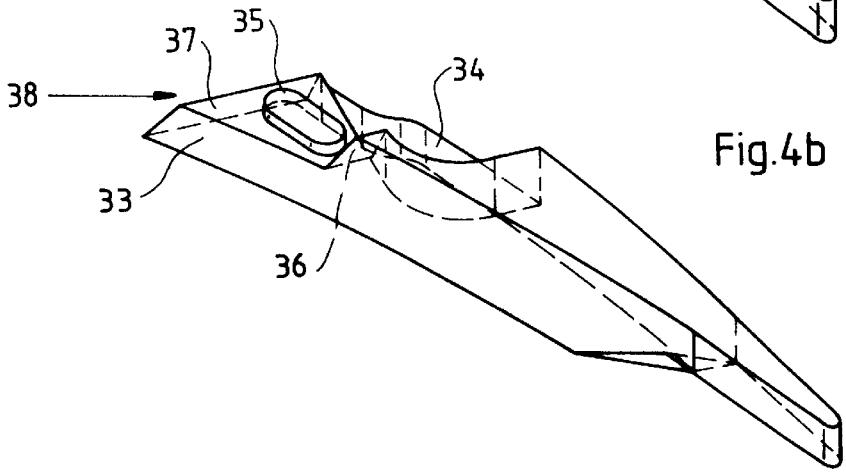

FIGS. 4, 4*a* and 4*b* show further exemplary embodiments of the invention. In FIG. 4 a fan blade 29 has an end region 30. In said end region 30 there is provided a recess 31 and two abutting surfaces 36, 37. The corresponding fan blade tips 32, 33 shown in FIGS. 4*a* and 4*b*, respectively each have abutting surfaces 36, 37 as well. In this exemplary embodiment, the fan blade tip 32 of FIG. 4*a* fits to the fan blade 29 of FIG. 4. The configuration of a cam 35 for engaging the recess 31 of the fan blade end 30 matches that of the recess, allowing for a match of said abutting surfaces 36, 37 of fan blade 29 and fan blade tip 32. Thus, the fan blade 29 and fan blade tip 32 contact along a contacting plane 38 with abutting surfaces 36, 37, thereby maintaining a final position of said fan blade tip 32 on said fan blade 29. FIG. 4*b* shows an exemplary embodiment which can be used for a fan wheel rotating in a different direction.

Fan blade tips 32 and 33 each comprise a recess 34 similar to recess 15 shown in FIGS. 1 and 2. The fan blade tips shown in the accompanying drawings can be made of any material. Further, by mounting fan blade tips formed of different materials, a balancing of the fan wheels 11, 12 can be achieved. In addition, any selected material, such as a light-weight plastic, can be reinforced with plated or coated reinforcing material. Furthermore, the shape of said cams 35 engaging a corresponding recess 31 is not limited to the shape of cam 35 shown in the drawings, but can be of any desired shape including rectangular, circular, square and so forth. Further, each cam 35 can be formed as a plurality of smaller cams. The recess 31 can, of course, be provided in the corresponding fan blade tips 32 and 33, respectively, with the cam 35 being provided on the corresponding fan blade end 30, in the mounting area.

FIGS. 4*a* and 4*b* represent that opposite hand tips can be provided for a blade in accordance with the present invention. Either tip can be mounted to the fan blade. The result is that opposite hand fans can be made from single fan bodies simply by mounting the desired hand tip.

It will be appreciated by those of ordinary skill in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. Device for product delivery including:

at least one fan wheel having a rotatable mount;

a plurality of fan blades included on said at least one fan wheel which define product receiving fan pockets for receiving signatures cut from a web; and attaching devices included on each of said fan blades for mounting replaceable fan blade tips to said fan blades, said fan blades further comprising:

an aligning means for aligning said fan blade tips with said fan blades.

2. Device according to claim 1 wherein said attaching devices further include:

an aperture formed in each of said fan blades for receiving clips mounted on said fan blade tips.

3. Device according to claim 1 wherein said attaching devices further include:

clips mounted on said fan blades for engaging apertures in said fan blade tips.

4. Device according to claim 1 wherein said attaching devices further include:

a fastening means for fastening said fan blades to said fan blade tips.

5. Device according to claim 4 wherein said fastening means engage receptacles provided in said fan blades.

6. Device according to claim 1 wherein said attaching devices further include:

recesses formed on ends of said fan blades for engaging cams on said fan blade tips.

7. Device according to claim 1 further including:

a plurality of said fan blade tips made of a plastic material.

8. Device according to claim 7, wherein said fan blade tips are coated with a reinforcing material.

9. Device according to claim 7, wherein said fan blade tips are plated with material other than plastic material.

10. Device according to claim 1 further including:

a plurality of said fan blade tips made of a foamed material.

11. Device according to claim 10, wherein said fan blade tips are coated with a reinforcing material.

12. Device according to claim 10, wherein said fan blade tips are plated with material other than foamed material.

13. Device according to claim 1 further including:

a plurality of said fan blade tips made of metal.

14. Device according to claim 13, wherein said fan blade tips are coated with a reinforcing material.

15. Device according to claim 13, wherein said fan blade tips are plated with material other than said metal.

16. Device according to claim 1 further including:

a plurality of said fan blade tips made of injection molded material.

17. Device according to claim 16, wherein said fan blade tips are coated with a reinforcing material.

18. Device according to claim 16, wherein said fan blade tips are plated with material other than injection molded material.

19. Device according to claim 1 wherein said aligning means further included:

a centering pin.

20. Device according to claim 1 wherein said aligning means further include:

abutting surface on said fan blades for contacting abutting surfaces of said fan blade tips.

21. Apparatus for transporting a web of material comprising:

at least one fan wheel;

a plurality of fan blades included on said at least one fan wheel, with fan pockets for receiving samples of said web of material being formed by adjacent ones of said fan blades, each of said plurality of fan blades having a mounting device for receiving a fan blade tip; and a plurality of fan blade tips, each fan blade tip being replaceably mounted on one of said plurality of fan blades, said fan blades further comprising:

an aligning means for aligning said fan blade tips with said fan blades.

22. Apparatus according to claim 21 further including:

a plurality of said fan blade tips made of a plastic material.

23. Apparatus according to claim 22, wherein said fan blade tips are coated with a reinforcing material.

24. Apparatus according to claim 21 further including:

a plurality of said fan blade tips made of metal.

25. Apparatus according to claim 21 wherein said aligning means further include:

abutting surfaces on said fan blades for contacting abutting surfaces of said fan blade tips.

26. A replaceable fan blade tip for attachment to a fan blade included on a fan wheel for transporting a web of material, said fan blade forming at least a portion of a fan pocket for receiving a sample of the web of material, said fan blade tip comprising:

an attaching device for mounting the replaceable fan blade tip to the fan blade;

an aligning means for aligning the replaceable fan blade tip with the fan blade; and a fastening means for fastening the replaceable fan blade tip to the fan blade.

* * * * *